United States Patent [19]

Huddle

[11] 3,958,588

[45] May 25, 1976

[54] ERECTION METHOD FOR VAULTED PAVILION

[75] Inventor: Carl Fred Huddle, Pleasant Ridge, Mich.

[73] Assignee: Tension Structures Co., Pleasant Ridge, Mich.

[22] Filed: June 21, 1974

[21] Appl. No.: 469,814

Related U.S. Application Data

[60] Division of Ser. No. 255,899, Feb. 14, 1972, Pat. No. 3,820,553, which is a continuation-in-part of Ser. No. 93,293, Nov. 27, 1970, abandoned.

[52] U.S. Cl. ..... 135/4 R

[51] Int. Cl.[2] ..... E04B 1/347; A45F 1/16

[58] Field of Search ..... 135/1 R, 3 R, 7 R, 7.1, 135/4 R; 52/86, 746, 63

[56] References Cited

UNITED STATES PATENTS

| | | | |
|---|---|---|---|
| 2,802,478 | 8/1957 | Fritsche | 135/1 R |
| 2,828,756 | 4/1958 | Worley | 135/3 R |
| 3,215,153 | 11/1965 | Huddle | 135/1 R |
| 3,424,179 | 1/1969 | Minot | 135/3 R |
| 3,496,686 | 2/1970 | Bird | 135/1 R |
| 3,535,834 | 10/1970 | Nichols | 52/86 |

FOREIGN PATENTS OR APPLICATIONS

| | | | |
|---|---|---|---|
| 639,161 | 4/1962 | Canada | 135/3 R |

*Primary Examiner*—John E. Murtagh

[57] ABSTRACT

A tent-like structure, hereafter called a pavilion with a series of curved arches and a panel of flexible membranous material attached to each pair of arches and tensioned in both directions with the panels concavely curved in the direction of the spacing of the arches as well as convexly curved in the other direction to minimize flutter and vibration and to enhance its load-carrying capacity. The panels are attached to the arches by inserting beads on their edges into tunnels in the arches so that the panels may slide lengthwise of the arches to tension them lengthwise. The arches are mounted on rails to swing from recumbent to upright positions and to slide toward each other, to to facilitate assembly of (attach) the panels to the arches, and away from each other, to tension the panels transversely. To move the arches apart and tension the panels transversely, extensible struts, such as toggles or jack-screws, are provided between (each pair of) the arches. Alternate arches may be made larger or smaller than the other arches to enable inside struts to be used without interference with the panels. End closures, of the same general construction as the body of the shelter which may close the ends of the shelter or nest with the body of the shelter to open the ends, may also be provided. The concave transverse curvature may be imparted to the panels in the manner disclosed in the applicant's application, Ser. No. 93293, filed Nov. 17, 1971, or by preforming the panels with such curvature.

8 Claims, 16 Drawing Figures

ERECTION METHOD FOR VAULTED PAVILION

CROSS-REFERENCE TO RELATED APPLICATIONS

This application is a division of application Ser. No. 255,899 filed Feb. 14, 1972, which is now U.S. Pat. No. 3,820,553 entitled "Pavillion With Series of Arches and Method of Assembling and Erecting It." Application Ser. No. 255,899 was a continuation in part of my application Ser. No. 93293 filed Nov. 27, 1970, now abandoned which was subsequently divided into my applications Ser. No. 339,333 filed Mar. 8, 1973, now abandoned and Ser. No. 323,539, filed Jan. 15, 1973, now abandoned both of which are entitled, "Pavillion With Series of Arches and Method of Assembling and Erecting It." The specification and the claims of application Ser. No. 339,333 have been amended and are still pending. The title has been changed to "A Vaulted Membrane Structure." Application Ser. No. 339,539 has been abandoned and the drawings transferred to a continuation in application Ser. No. 523,459, filed Nov. 13, 1974 entitled, "Erection Method for a Vaulted Membrane Structure," to enter the amended specification accepted for application Ser. No. 339,333.

This invention related to pavillions, which consist of a covering of flexible membranous material supported by a number of arches of which the structure shown in the Fritsche U.S. Pat. No. 2,797,696 dated July 2, 1957 and the Brogren U.S. Pat. No. 2,225,972 dated Dec. 24, 1940 are examples. Particularly, the invention relates to membrane shelters of this type which are made up of similar frame units, for a modular effect, to support the flexible membrane cover as illustrated and described in my applications listed above.

SUMMARY OF INVENTION

The principal objects of the invention are to provide a vaulted pavilion of this type in which the tendency of the covering material to wrinkle and flutter or vibrate in gusty winds is minimized and the ability of the covering material to carry heavy wind loads and heavy loads of snow or ice without undue strain is enhanced, and methods of assembling and erecting such pavilions, and constructions which, among other things, facilitate the attainment of the first-mentioned objectives.

It is a particular object of the invention to provide a method of assembling and erecting such pavilions a construction which (eliminate slack from) tensions the lower ends as well as the upper ends of the panels.

It is another object of the invention is to provide end closures for pavilions of the type described which are movable to positions in which the ends are substantially completely open and, in particular, to closures of this type which partake of the characteristics of the bodies of the vaulted pavilions.

It is a further object of the invention to provide a pavilion of this type under consideraion in which inside arch-spacing struts may be used without interference with the panels.

For a full understanding of the nature and objects of the invention, reference is made to the following specification and the accompanying drawings wherein preferred embodiments of the invention are described and shown.

DESCRIPTION OF PREFERRED EMBODIMENTS

Figure 3:
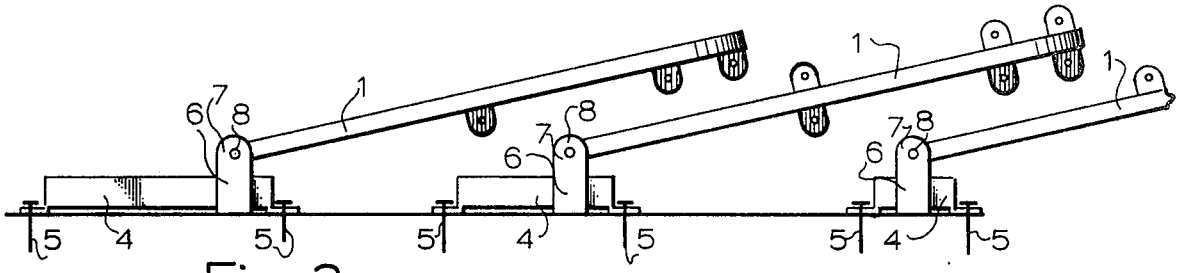
FIG. 3 is a side elevation of a portion of the pavilion in an initial stage of erection.
Figure 4:
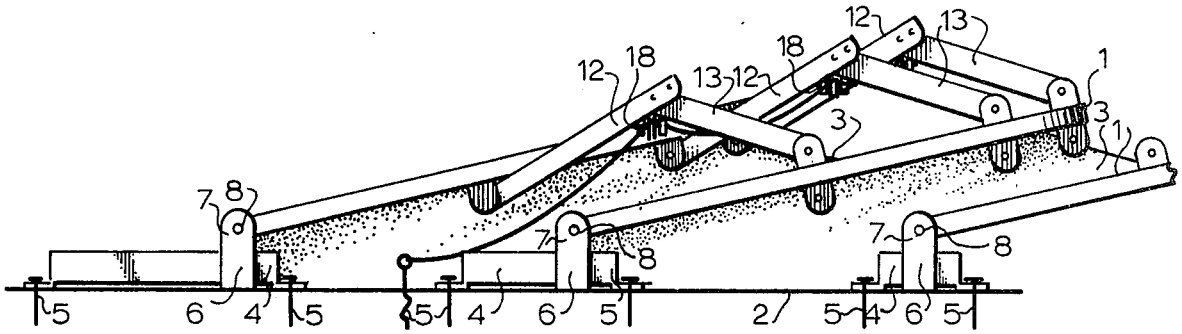
FIG. 4 is a similar view of the pavilion in a second stage of erection.
Figure 5:
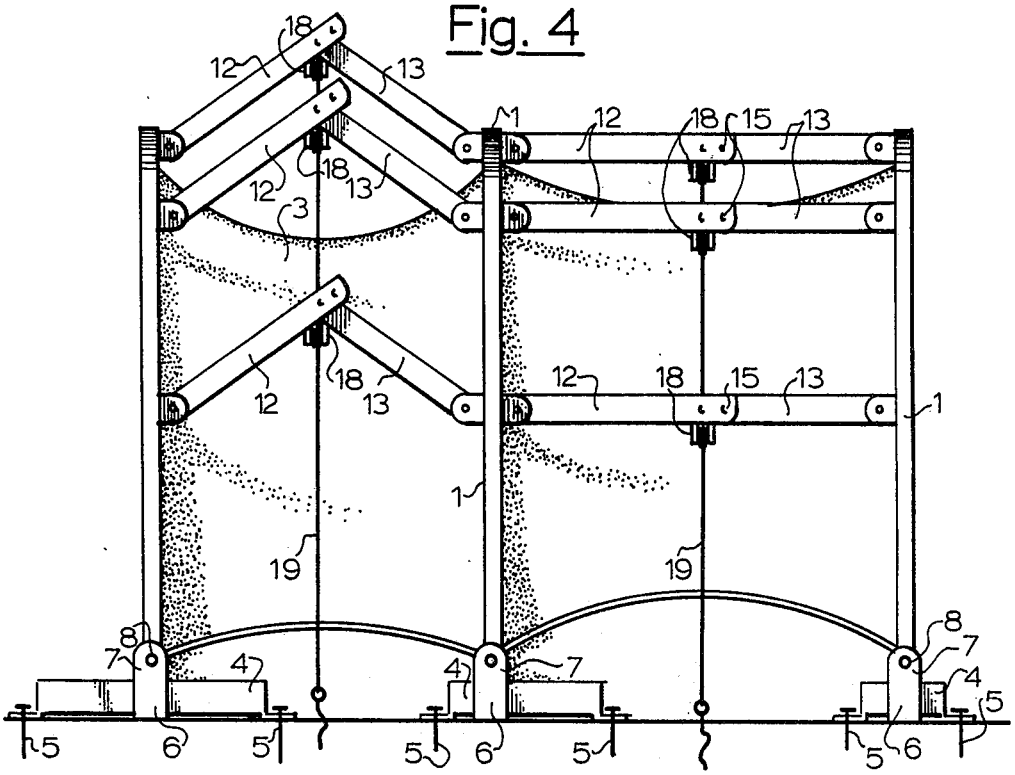
FIG. 5 is a similar view of the pavilion in a third stage of erection.
Figure 6:
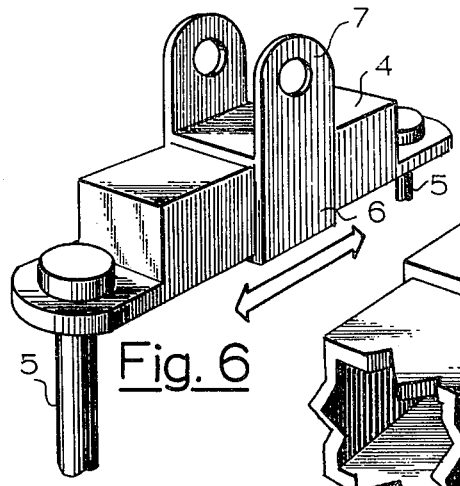
FIG. 6 is an enlarged perspective view of an individual rail and a mounting bracket for one end of an arch.
Figure 7:
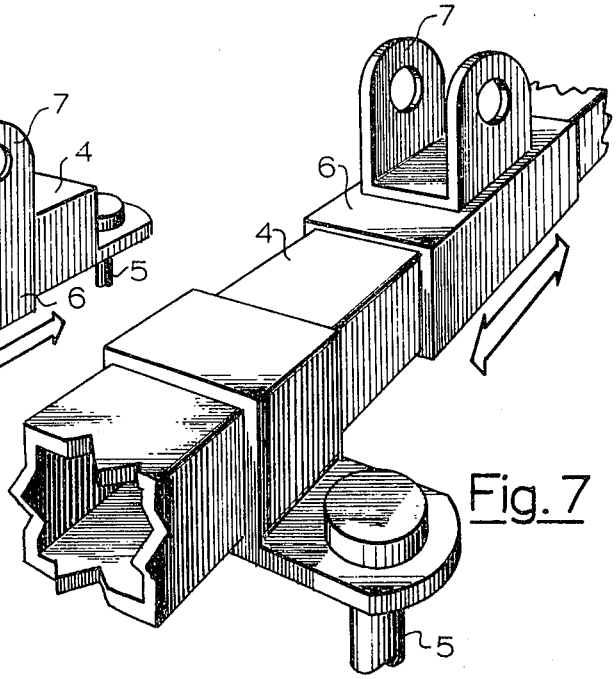
FIG. 7 is a similar view of a portion of a rail for one end of a number of arches and one of the mounting brackets on it.
Figure 8:
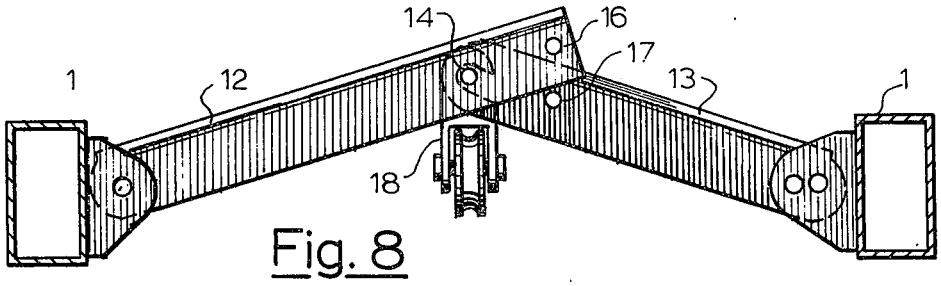
FIG. 8 is an enlarged sectional view of a pair of arches and an associated strut.

The pavilion shown in the drawing includes a series of curved arches 1 mounted to swing on the ground or other base 2 from the recumbent positions in which they are shown in FIGS. 3 and 4 to the upright positions in which they are shown in FIG. 5 and other views. Between each pair of arches, except one or more intermediate pairs, there extends a panel 3 of flexible membranous material, such as a suitable coated fabric which is stretchable within limits. Each edge of each panel is suitably attached to each of a pair of adjacent arches as shown in FIGS. 8 and 10.

The panels 3 of covering material are, of course, convexly curved in transverse cross sections. They are also shallowly concavely curved in longitudinal cross-section (say, so that) with the "sag" (is something like 10 percent) at least 5 percent of the distance between the arches and tensioned in both directions in order to minimize the tendency of the material to flutter or vibrate in gusty winds and to enhance its ability to carry heavy loads of snow or ice without undue strain.

Figure 9:
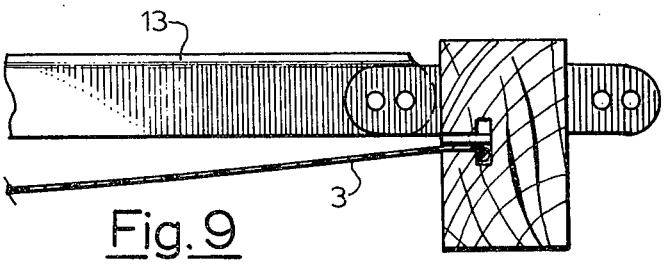
FIG. 9 is a similar view of a modified arch and a portion of an associated strut and panel.
Figure 10:
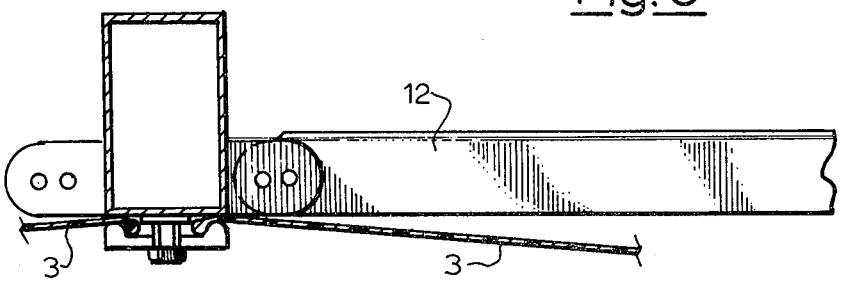
FIG. 10 is a similar view of another arch and a portion of an associated strut and panel.

To facilitate the realization of the structure described, the panels 3 are, as shown in FIGS. 9 and 10, attached to the arches so that their edges may slide lengthwise thereof and the panels thus be tensioned lengthwise. (and) The arches (are) can be mounted so that they may be moved toward each other to facilitate attachment of the panels of covering material to them, and then away from each other, to tension the panels transversely. To tension and depress the panels between the arches to minimize their tendency to flutter and vibrate and enhance their load-carrying capacity, there are provided, in the lower edges of the panels, one or more tension rings 30 of the type disclosed in my aplication Ser. No. 82457, filed Oct. 20, 1970.

Figure 16:
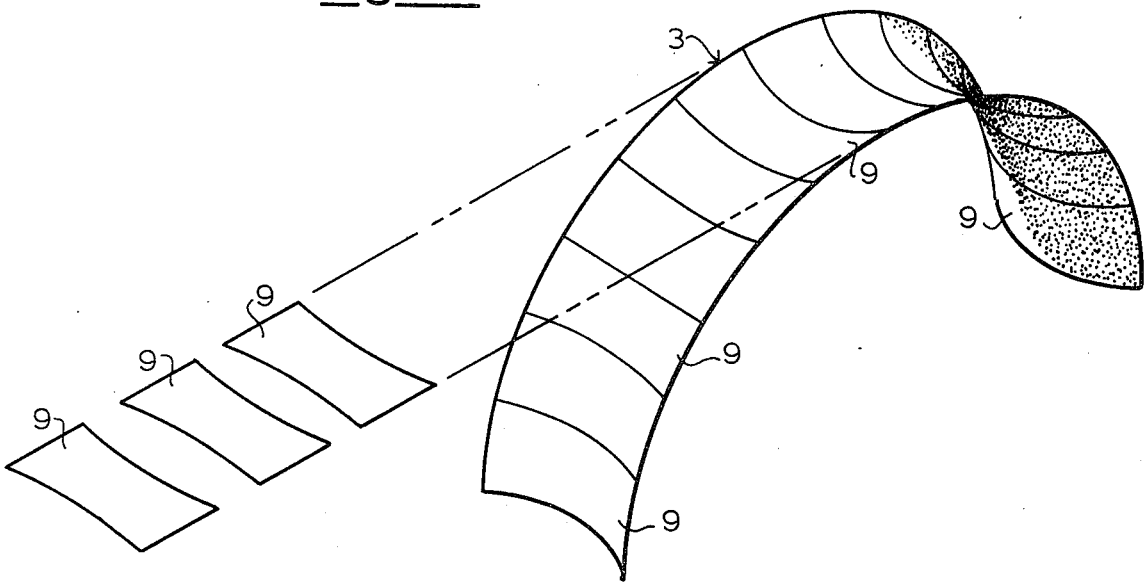
FIG. 16 is a perspective view of a modifed form of panel.

Each of these tension rings consists of a cable which extends through an arched tunnel in or on the panel of covering material with its ends attached to the base 2 or to the arch leg above or near the base as illustrated. The concave longitudinal curvature may be imparted to the panels as disclosed in the applicant's application Ser. No. 93293 or by preforming the panels as indicated in FIG. 16 or otherwise. In FIG. 16. the concave longitudinal curvature is imparted to the panels 3 by making them in sections 9 of hour-glass profile joined along their curved edges.

To mount the arches so that they may be moved toward and away from each other, there are provided at the lower ends of the legs of the arches 1, rails 4 which extend lengthwise of the pavilion and are attached to the base 2 by pins 5. Mounted to slide on the rails are brackets 6 with upstanding ears 7 for each of the legs of the arches. There may be a pair of rails to accommodate each of the arches or a single pair of rails to accommodate a number or all of the arches in the pavilion. The former alternative is shown in FIGS. 3, 4, 5 and 6, the latter in FIGS. 1, 7, 11, 12 and 14.

The lower ends of the legs of the arches are mounted to swing on pins 8 which extend through them and the ears 7 on the brackets.

As indicated in FIG. 4, the panels 3 are preferably attached to the arches when the arches are in recumbent positions and the brackets are closer together than they are in the finished structure. Then the arches are erected and moved apart to impart the desired degree of tension to the panels transversely. Any of a number of expedients may be employed to prevent the arches bunching together as they are raised.

To move apart the arches between the panels 3 extend and tension the panels transversely and hold them in this position, there (are) can be provided between each pair of the arches toggles 11 which consist of struts 12 and 13 whose outer ends are mounted to swing with respect to each other on a pin 14 which extends through both. After the arches are erected, the toggles are straightened to move the arches apart and impart to the panels of covering material and the desired tension transversely. To hold the struts aligned, there are provided pins 15 which extend through holes 16 and 17 which register when the struts are aligned.

To facilitate straightening the toggles, there may be provided at the adjacent ends of the struts 12 and 13 pulleys 18 and cables 19 which run over the pulleys. After the arches are erected, they may be moved apart to the desired extent by pulling downwardly on the ends of the cables.

To permit retensioning of panels 3 in the event (slack develops) tension decreases or it is desired to increase the tension in them, somewhat longer toggles may be substituted for the original toggles or in the original toggles may be made adjustable by providing alternate holes for the swing pins at their inner ends or their outer ends as shown in FIGS. 8 and 9 or both. If the rails 4 are long enough the space necessary to permit the retensioning may be obtained by moving one or both ends of the pavilion outwardly.

Where this is not possible or feasible, the necessary space may be obtained by providing an expansion module or modules 20 which the spaces between the pairs of arches not bridged by toggles constitute. These spaces may be closed in any suitable manner, such as by panels 10 of flexible membranous material similar to the panels 3 and with similar tension rings 30 in them, but tensioned transversely only to the extent they may be, without separation of the arches, to which they are attached.

Figure 1:
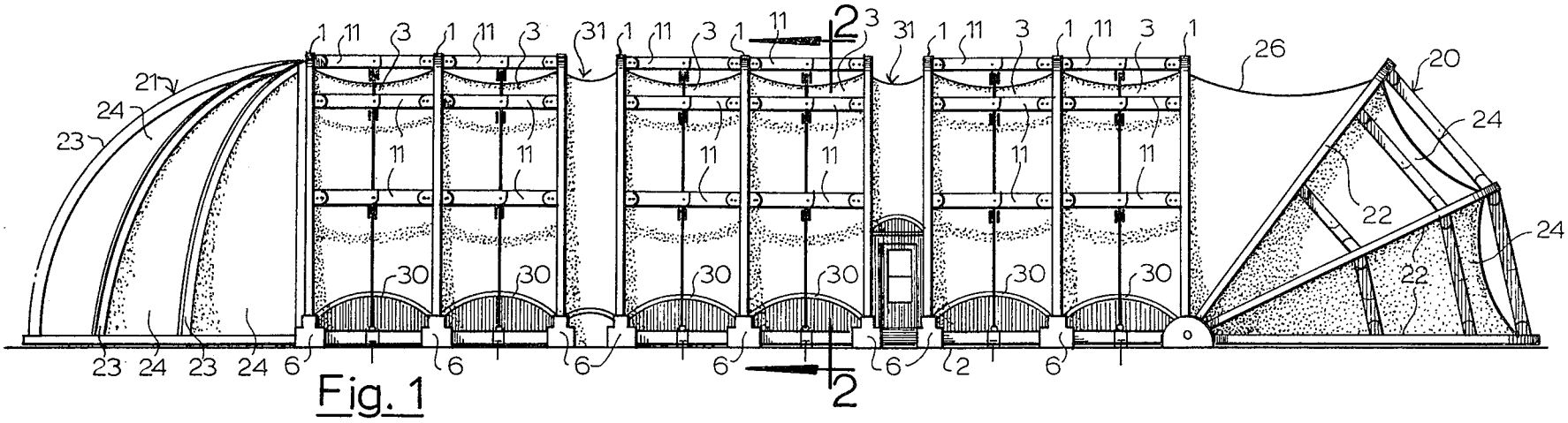
FIG. 1 is a side elevation of a pavilion in accordance with the invention.
Figure 2:
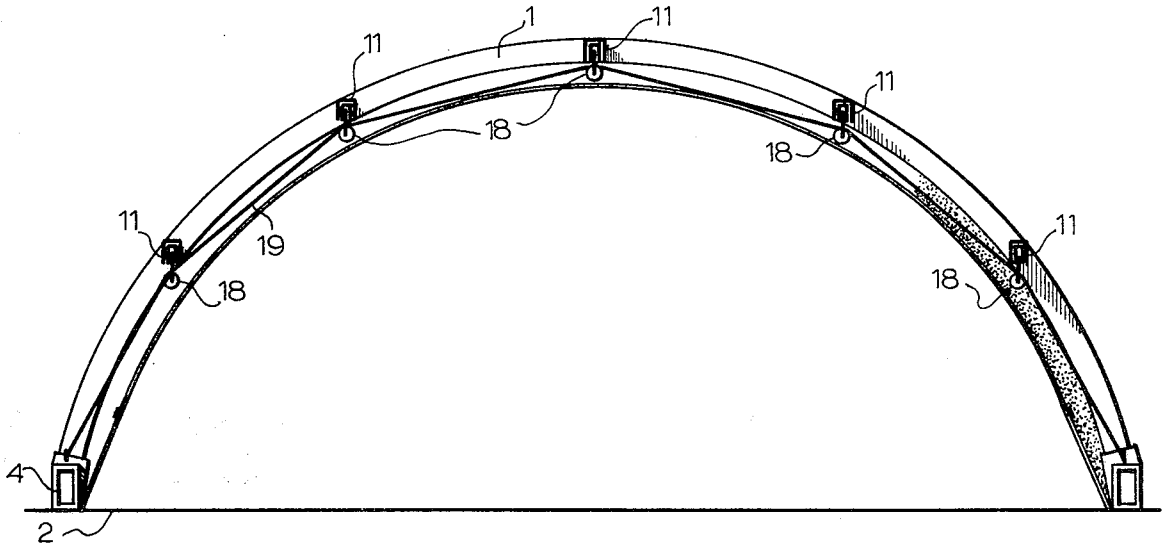
FIG. 2 is an enlarged section on the line 2—2 of FIG. 1.

Suitable closures may be provided for one or both ends of the pavilion such as the accordion-like closure 21 at the left end of FIG. 1, which may be collapsed to open the ends, or a similar (structure) closure 20, in which the arches swing on a horizontal axis as (do the arches of the closure) shown at the right end (or the structure 20 shown at the right end of FIG. 1 which). It is not necessary to collapse the closure 20 shown at the right end of FIG. 1, to open the end. The closures 20 and 21 are generally similar in construction to the body of the pavilion in that they are made up of semi-arches 23 in the case of the closure 21 and arches 22 in the case of the closure 20 and panel 24 of flexible covering material which extend between and are operatively attached to, the arches.

The summits of the semi-arches 23 of the closure 21 converge at the summit of the adjacent outermost arch 1. The closure 21 can be made in two halves which meet at a projection of the centerline of the pavilion to close the end of the pavilion. The semi-arches can be mounted to swing about a vertical axis at the point of convergence of their summits to collapse each half against a leg of the nearer end arch 1 and open the end of the pavilion.

Figure 11:
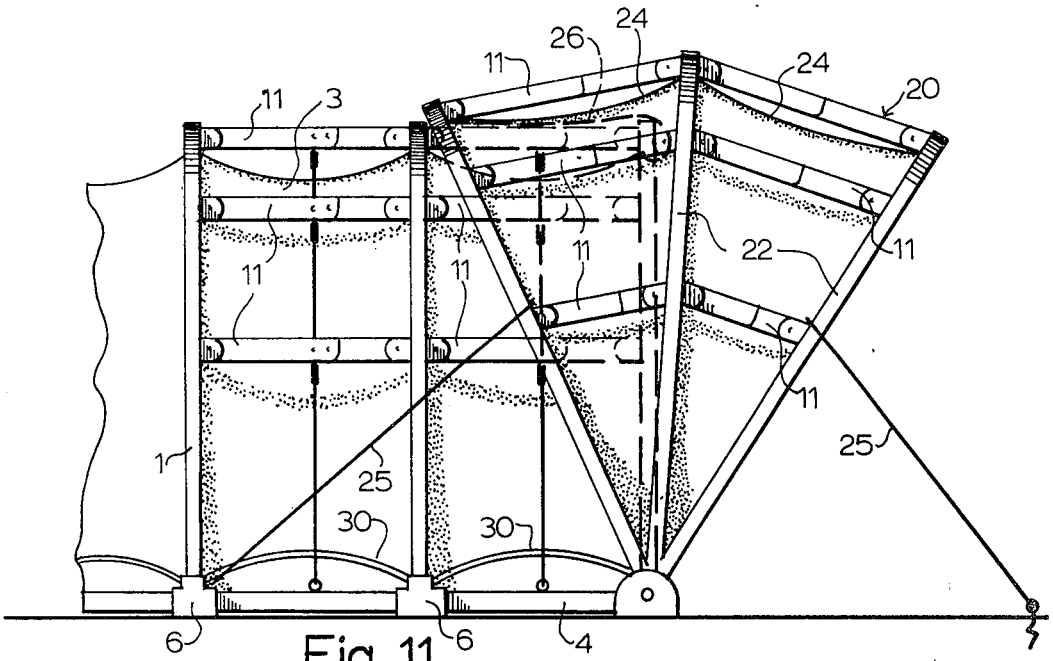
FIG. 11 is a side elevation of the end of the pavilion which is shown at the right in FIG. 1 with the arches mounted on a rail of the type shown in FIG. 7 and the end closure in open position.

The arches 22 of the closure 20 at the right end of FIG. 1, on the other hand, are mounted to swing on a horizontal axis coincident or near the axis of the adjacent outer arch 1. The arches 22 are held apart as are the arches 1 with the panels 24 under tension by struts which may be similar to the toggles 11. The arches and the panels are, consequently, not collapsed and extended to open and close the end of the pavilion but swing as a unit from the position in which they are shown in FIG. 1 to that in which they are shown in FIG. 11. So that the innermost of the arches 22 may swing past the outermost of the arches 1 to open and close the end, the arches 22 are made sufficiently wider and higher than the outermost of the end arches 1 and mounted outwardly thereof. Suitable means such as the tie-downs 25 may be provided to hold the closure 20 open.

To close the gap between the innermost of the arches 22 and the outermost of the arches 1, there is provided a panel 26 similar to the panels 3 and 24 of which one side is attached to each of the arches and is folded upon itself and overlies the outermost panel 3 when the end of the pavilion is open.

Figure 14:
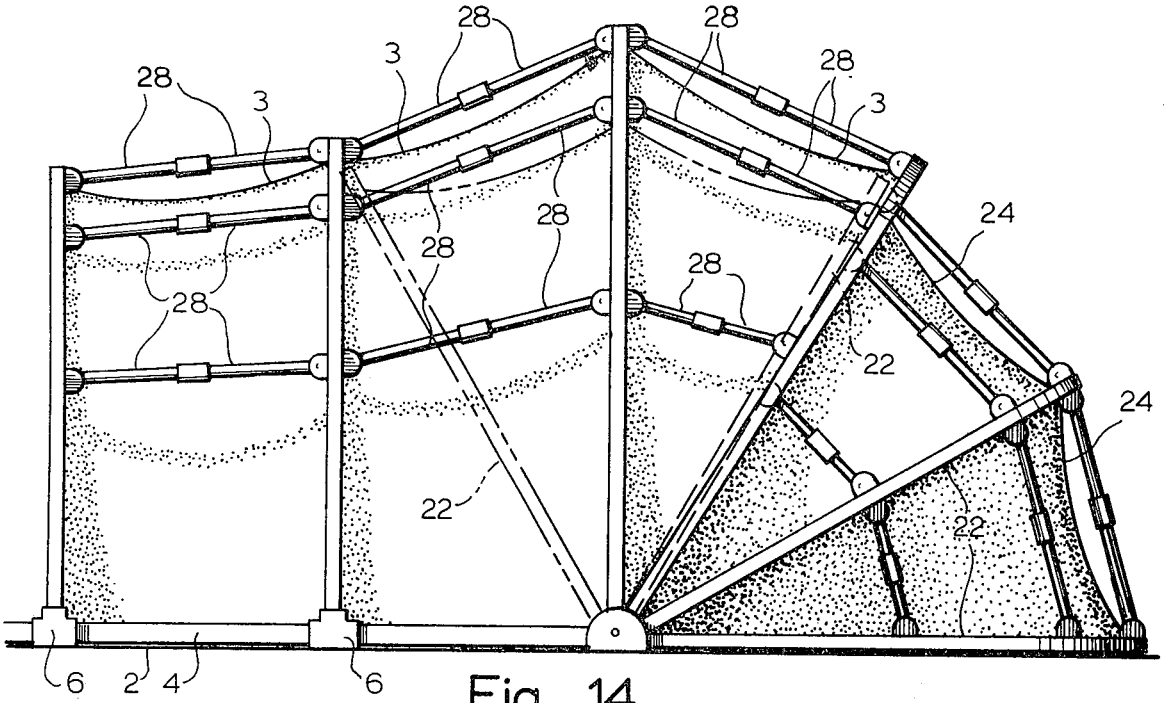
FIG. 14 is a side elevation of one end of a pavilion equipped with a modified end closure.
Figure 15:
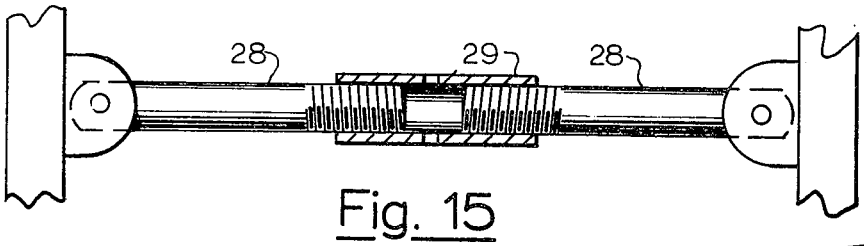
FIG. 15 is a view of portions of two arches and an interposed strut of modified form.

Instead of the toggle type struts 11 shown in the preceding figures, there may be employed jack-screws such as that shown in FIG. 15 which consists of rod-like end members 28 which are mounted to swing on the arches and oppositely threaded at their inner ends and an intermediate sleeve 29 which is threaded onto the ends of the rods. It is to be noted that struts of this type are employed in the structures shown in FIGS. 12, 13 and 14.

As shown in FIG. 14, end closures of the type shown at the right side of FIG. 1 may be made to nest inside instead or outside the body of the pavilion without loss of head or side room by increasing both the lateral and vertical dimensions of the outermost arches 1 of the body and making the arches 22 of the closures commensurate in size with the other arches 1 of the body so that the latter can be swung into the body of the pavilion. Instead of providing a reversible panel of covering material between the outermost of the arches 1 of the body of the pavilion and the innermost of the arches 22 of the closure, there may be provided at the end of the body an outwardly inclined arch 30 which overlaps the inner end of the closure when it is in its closed position.

Figure 12:
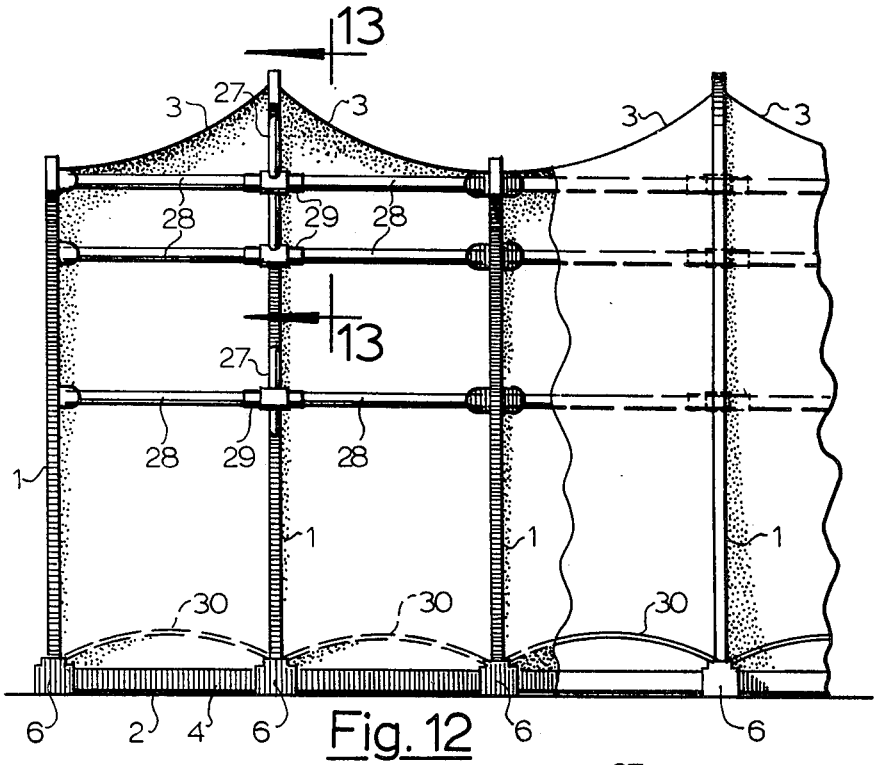
Figure 13:
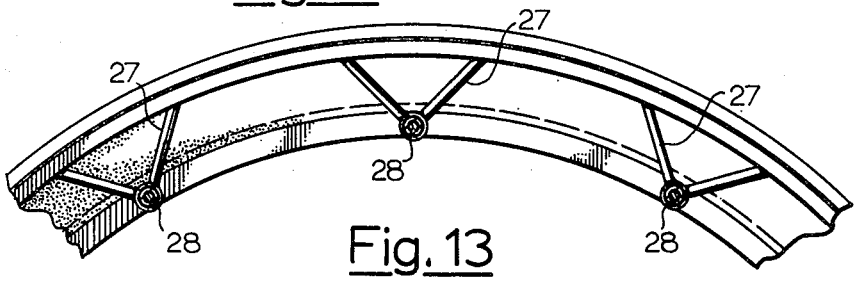
FIG. 13 is a fragmentary section on the line 13—13 of FIG. 12.

To eliminate the possibility of build-up of snow and ice on the panels 3 behind the struts, the struts may be located inside instead of outside the panels, as shown in FIGS. 12 and 13. In this location, the struts may be made to clear the panels by making alternate arches 1 larger and smaller in lateral as well as vertical dimensions and disposing the struts between successive smaller arches. The provision of external struts between the larger arches would to some extent defeat the purpose of the construction so the panels 3 are preferably relied upon to keep the larger arches in the desired relation to each other. In addition, there may be provided anglular stabilizers 27 which extend from the middles of the struts 28–29 to the adjacent larger arch to minimize any tendency of the struts to buckle.

However, the alternate larger and smaller arch construction shown in FIGS. 12 and 13 may be employed with external struts between the larger arches instead of or in addition to internal struts between the smaller arches with some advantage because of the greater clearance between the struts and the panels 3 at their middles.

I claim:

1. In the construction of a vaulted membrane shelter comprised of at least two substantially vertical arches with curved bights mounted on the ground or other base face to face but spaced apart and fixed in space to form a vaulted framework; a roof membrane, extending between, and operatively attached to said arches and said base that is tensioned longitudinally and transversely with an inward concave curvature of at least 5 percent of the distance between said arches; the method of erection that includes the following steps:

a. assembling said arches on said base
b. raising said arches to an upright position and fixing them in space in substantially their erected positions
c. installing said roof membrane by operatively attaching it to said arches in sections or as a whole
d. pulling and sliding said roof membrane along said arches downward toward said base
e. tensioning said membrane downward between said arches and securing it:
   1. directly to said base;
   2. indirectly to said base by at least one tension ring with its ends attached to:
      a. said base;
      b. the lower portion of said adjacent arches.

2. The erection method described in claim 1 wherein the fixing of the arches in space includes at least one strut extending between and attached to said arches.

3. The erection method described in claim 1 wherein the fixing of the arches in space includes a tension member that extends from each end arch to said base.

4. The erection method described in claim 1 wherein said arches are attached to said base for horizontal adjustable movement after being raised to their erected position for spacing and alignment.

5. The method described in claim 1 wherein said vertical arches are fixed in their vertical positions by erecting at least one semi-arch acting between at least one terminal vertical arch and the base in step (b) by attaching one of its ends to the terminal vertical arch near its apex and its opposite end attached to the ground or base to form a unit frame with said vertical arches and to also support a flexible membrane closure for the shelter.

6. The method described in claim 5 wherein at least one flexible membrane end closure is installed along with said roof membrane, as a unit of, or as a segment of, said roof membrane, is operatively attached to said terminal vertical arch and said vertical semi-arch, and is tensioned with an inward curvature between them, when said roof membrane is tensioned and is secured to the base by at least one tension ring embodied in the lower portion of said membrane with its ends attached to: (a) the lower portion of said semi-arches; (b) to the base.

7. In the construction of a vaulted membrane shelter comprised of at least two substantially vertical arches with curved bights mounted on the ground or other base face to face but spaced apart and fixed in space to form a vaulted framework; a roof membrane, extending between, and operatively attached to said arches and said base that is tensioned longitudinally and transversely with an inward concave curvature of at least 5 percent of the distance between said arches; the method of erection that includes the following steps:

a. disposing said arches on said base with their corresponding ends aligned and their crowns similarly oriented in substantially recumbent positions but spaced apart to facilitate attachment of said membrane
b. operatively attaching said roof membrane to at least a portion of the crown of said arches
c. raising the arches, with the membrane attached, to substantially their erected positions and fixing them in space
d. tensioning said membrane downward and securing it:
   1. directly to said base
   2. indirectly to said base by at least one tension ring with its ends attached to:
      a. said base
      b. the lower portion of said arches.

8. The method described in claim 7 wherein the fixing of said arches in space includes:

a. at least one strut extending between and attached to said arches
b. a tension member that extends between at least one end arch and said base
c. a closure frame that includes at least one semi-arch that has one of its ends attached to the crown of an end arch and its other attached to said base
d. a closure that includes at least one arch inclined outward away from the center of the shelter with its ends mounted on the base adjacent to the respective ends of an end arch; a flexible membrane that extends between said end arch and said inclined arch with means to anchor the crown of said inclined arch to said base
e. a tensioned closure that acts between an end arch and said base.

* * * * *